US005107750A

United States Patent [19]

Buchstaller et al.

[11] Patent Number: 5,107,750

[45] Date of Patent: Apr. 28, 1992

[54] FEEDING AMMUNITION

[75] Inventors: Manfred Buchstaller, Salem; Friedrich Moessmer, Oberteuringen, both of Fed. Rep. of Germany

[73] Assignee: Dornier GbmH, Fed. Rep. of Germany

[21] Appl. No.: 693,772

[22] Filed: Apr. 26, 1991

Related U.S. Application Data

[63] Continuation of Ser. No. 137,879, Dec. 24, 1987, abandoned.

[30] Foreign Application Priority Data

Dec. 24, 1986 [DE] Fed. Rep. of Germany ..... 3644513

[51] Int. Cl.[5] ..... F41A 9/02; F41A 9/04

[52] U.S. Cl. ..... 89/33.17; 89/34

[58] Field of Search ..... 89/33.17, 33.5, 34, 89/33.16, 33.25

[56] References Cited

U.S. PATENT DOCUMENTS

| | | | |
|---|---|---|---|
| 2,329,308 | 9/1943 | Trotter et al. | 89/33.5 |
| 2,342,022 | 2/1944 | Trimbach | 89/34 |
| 2,364,309 | 12/1944 | North | 89/33.5 |
| 2,384,746 | 9/1945 | Holloway | 89/33.5 |
| 2,396,136 | 3/1946 | Trotter | 89/33.5 |
| 2,464,905 | 3/1949 | Turnbull | 89/33.5 |
| 2,608,133 | 8/1952 | Ransom et al. | 89/33.5 |
| 3,687,004 | 8/1972 | Faisandier | 89/33.5 |
| 4,252,049 | 2/1981 | Franz et al. | 89/34 |
| 4,412,611 | 11/1983 | Golden | 89/34 |
| 4,424,735 | 1/1984 | Bacon et al. | 89/34 |
| 4,573,395 | 3/1986 | Stoner | 89/34 |

FOREIGN PATENT DOCUMENTS

| | | | |
|---|---|---|---|
| 954896 | 1/1950 | France | 89/33.5 |
| 558949 | 1/1944 | United Kingdom | 89/33.5 |
| 722226 | 1/1955 | United Kingdom | 89/33.5 |

*Primary Examiner*—Stephen Johnson
*Attorney, Agent, or Firm*—R. H. Siegemund

[57] ABSTRACT

Device for feeding ammunition to an aircraft firing gun, without using belts includes an ammunition container having a plurality of partitions to establish a plurality of different levels; a pair of endless chains being interconnected and run over at least one drive wheel and a plurality of deflection and buffer wheels for running the endless chains of the pair in two loops through all of the said levels of the plurality of levels; the deflection wheels being secured to each other for common movement such that as one loop increase the other one decreases; a normally biased spring releases on firing and acts on one of the loops to obtain full feeder movement during start-up of a booster motor, thereby forcing one loop to increase the other one to decrease.

6 Claims, 3 Drawing Sheets

FEEDING AMMUNITION

This is a continuation of co-pending application Ser. No. 137,879 filed on Dec. 24, 1987, now abandoned.

BACKGROUND OF THE INVENTION

The present invention pertains to feeding munition in a self drawing guns particularly guns on aircraft wherein the drawing and feeding is supported by a booster motor.

Conventional belted munition feeding system for aircraft machine guns are expensive and of limited integratability. Moreover, they are fairly easy subject to interference on account of negative g-forces. Thus, single barrel revolver type guns have been developed which load under gas pressure and they as well as open shooting guns are operated without linkage member type ammunition feeding belts.

Ammunition feed systems without articulated belt members have an inherent disadvantage in that in the beginning of salvo the entire supply of ammunition including the transport mechanism has to be accelerated within very short period of time to the firing speed of the gun. In the case of a gas pressure loading gun with start-up-free firing speed at a rate of more than 2000 rounds/minute, accelerations are observed which even in the case of high speed reacting and strong booster ammunitions will lead to unacceptable interruptions of the high rate firing sequence. In the case of a larger number of rounds a complete stop is not to be excluded.

DESCRIPTION OF THE INVENTION

It is an object of the present invention to provide a new and improved ammunition feeding device which permits high speed of firing during start-up.

In accordance with the preferred embodiment of the present invention it is suggested to provide on any munition container with a plurality of intermediate bottoms or bottom partitions so that the ammunition is stacked in that container in several levels one above each other. Endless chains are provided and at least one drive wheel and several deflection wheels cooperating with a transfer unit for feeding and removing ammunition and/or spent shells in that the device as such is provided with at least two movably disposed loop forming arrangements such that ammunition is fed to the transfer unit from the beginning of firing at the firing rate while the booster motor still accelerates.

The booster motor is preferably a linear motor coupled to one of the deflecting wheels which serves as a drive wheel. Preferably, that wheel is an immediate feed wheel that feeds into that loop which is closed to the exit for ammunition from the container. In furtherance, the two loops are interconnected under utilization of guide shells. This way, the loops fill and feed in opposition. The chain that moves the ammunition is moved instantly on a firing command by discharge of a gas spring while the booster motor is run up. One of the partitions is preferably provided as telescopic device to accommodate the oppositely moving loops and their oppositely varying extensions. The transfer unit for transferring shells out of and back into the container is preferably situated in one corner and includes a transfer wheel, two guide shells and a feed wheel that actually pertains to the gun.

Hence the invention provides for an active ammunition buffer which during start-up compensates the inertia of the ammunition which is disposed in front of the gun. The loading of the gun and the existing booster motor are supplemented by the inventive equipment during the initial phases so that an overall fast reacting system obtains. Owing to the integration of the munition buffer as per the preferred embodiment of the invention one obtains a variety of advantages which permit the adaption of the principles underlying the solution to gun systems such that start-up free high rates of firing obtains particularly in high performance aircraft wherein an interference-free function is required and loading obtains in the shortest possible time without equipment breakdown and other interference. These then are the advantages.

First, there is a compact configuration of the outer contour of the munition container. Its volume is smaller than in case of belted munition and continuous use of free volume is possible by way of a "feedback" of spent shells and duds. The integrated munition buffer is of simple construction with a minimum in rotating and accelerating parts which in turn increases start-up dynamics, reliability of the system as a whole and use life. There is an optimum matching of munition buffer volume to the feed power of the gun and the requirements on the transport are minimized so that the booster and energy supply is reduced. This latter feature offers the advantage of weight reduction which is an important consideration for aircraft. Loading and unloading of the munition container is possible without removing the container from the system which means that this particular kind of system can be used in areas where space is narrow and critical. The gun transport system is supported particularly at the beginning of a salvo so that the firing speed is very high right from the beginning. The feedback feature mentioned above saves space and the freed volume can be used otherwise. The turnaround time is very much reduced since the loading and unloading of the ammunition system on ground can occur concurrently.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
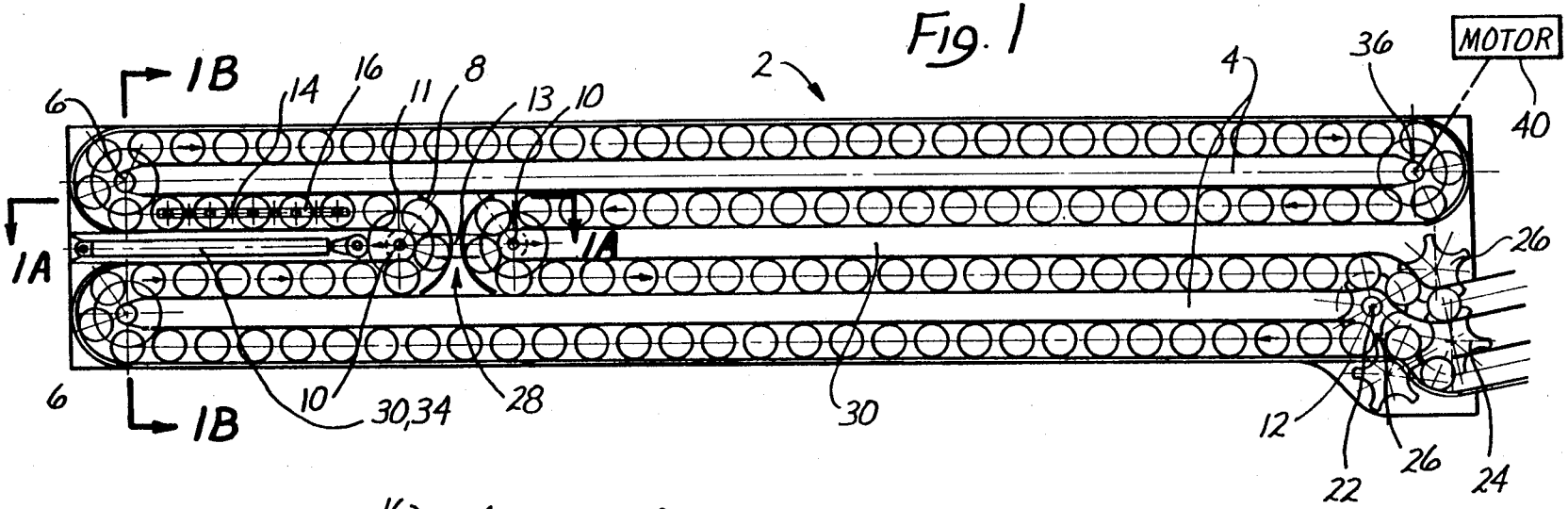
FIG. 1 is a schematic section view into a feed system in accordance with the preferred embodiment of the present invention for practicing the best mode thereof.
Figure 1B:
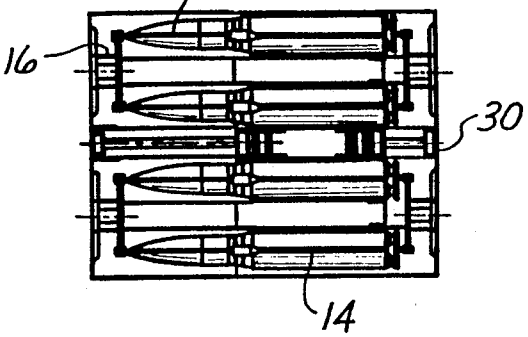
FIG. 1*a* and FIG. 1*b* are detail views into the feed system of FIG. 1, respectively along lines AA and BB.
Figure 1A:
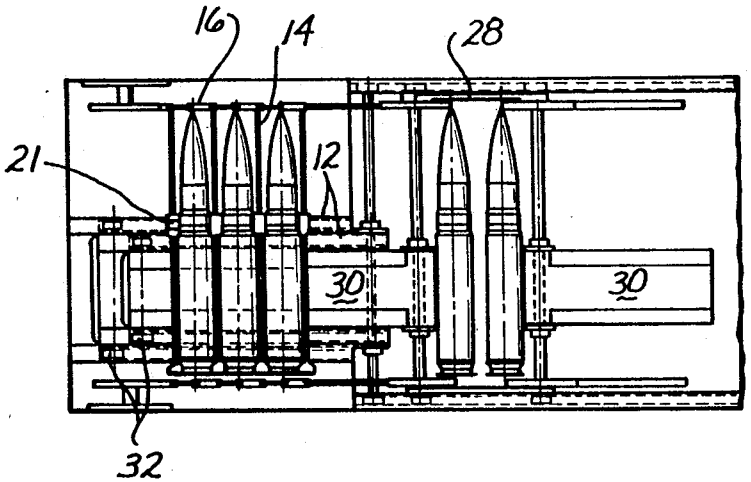

Proceeding now the detailed description of the drawings, FIG. 1 and others show the following basic or principal or main components being subassemblies in each instance; an ammunition container 2, a conveyer chain 16, a transfer unit 20 and an acceleration device 10 with booster motor.

An ammunition container 2 is specifically shown in FIG. 1 but also in others and includes shape-stable, intermediate partitions or bottoms 4 made of a light metal. Ammunition is stored in that container in four different layers or levels. Transportation obtains in each of these layers or levels from one level to the next one. The individual rounds are disposed and assembled which loops, as far as control is concerned, are formed by several deflection devices including deflection pulleys or wheels 6, guide members 8, drive wheels 36 and buffer wheels 11. In this case the buffer wheels 11 can also be termed deflection wheels and are in this case movably mounted; the movable mounting distinguishes them from the other deflection wheels 6.

The ammunition is guided along upper and lower sides of the partitions 4 as well as along the deflection and guide members 8 adjacent wheels 11, to thereby run along two slide/roller rails 12. Note specifically that there are three partition levels, the middle one is interrupted to establish two loops to be described below. The track defining rails 12 are made of a low wear synthetic material, e.g. a polyamide material known under the name of "NYLATRON". There is little play provided as far as the placement of the individual rounds are concerned.

Stiff but thin conveyer rods 14 are arranged respectively in front or behind of a round or shell and establish separation between them throughout the container 2 as far as movement as well as storage proper is concerned. The shell or cartridge deflection wheels 6 and 11 provide a connection between individual layers. Together with two chains 16 these rods 14 complete a conveyer for the shells.

Looking at the lower right hand corner of FIG. 1 one can see an inwardly pointing arrow that leads to the bottom layer in container 2. There is an outwardly pointing arrow that leads away and out from the second level of shells. The lower wheel 6 moves the cartridges up above the lowest one of the partitions or intermediate bottoms 4. The cartridges are then taken by one of the wheels 11 and moved up along the left hand portion of the uppermost bottom partition and moved by the upper wheel 6 to the highest level etc. Note that the conveyer to be described in detail below leads out also near the lower right hand corner.

A second major component, as stated above, is a pair of endless conveyer belts or chains 16 made of high tearproof material and being of corresponding construction provided to both ends of ammunition. These chains are arranged on both ends of the ammunition and are interconnected to provide a constant spacing by means of the rods 14. The spacing (in direction of transport) is given by the diameter of the shells plus the effective transport (width) portion of rods 14 plus a little play. The thus produced endless conveyer chain is run in several loops through all the levels by operation of deflection through wheels 6,11,22 and 36 of the container 2. In order to avoid engagement of the rather sensitive peaks of each ammunition cartridge as well as the shell bottoms by the chain elements 16, the individual rounds will be axially fixed through a suitably contoured piece made of wearproof material. Those pieces are axially fixed on one respective side of the transport rods 14.

Figure 3:
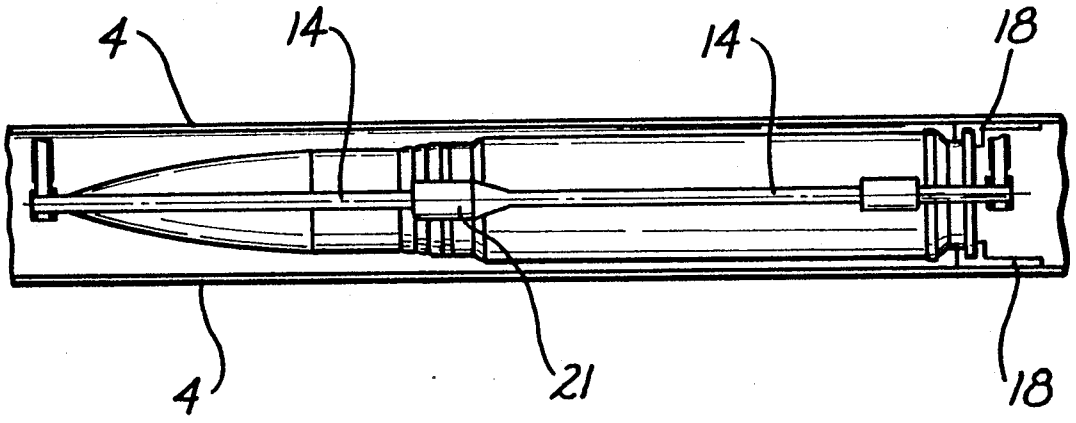
FIG. 3 shows a detail of a modification of cartridge guiding in any of the two embodiments above.

FIG. 3 shows an alternative cartridge guide system. In this case the guiding is providing through a U or L shaped section piece 18 of the same material and being arranged on at least one side of each of the intermediate bottoms 4. Each round will roll in a withdrawal groove of the bottom. This way one avoids the otherwise known axial guiding of a chain, here then through a considerable simplification of construction. Only the tension in the chain has to be considered.

In order to avoid skewing of individual rounds in the transport facility each rod 14 may carry a second, shape matching piece 21 also being made of a wearproofing material such as the above mentioned which is a polyamide NYLATRON; the location being above the center of gravity of the respective rounds. Cartridges and shells have to be moved and guided concurrently which obtains through positioning of this material in the level of the transfer from shell to cartridge.

A third major unit is the transfer unit 20 which also includes a plurality of elements. In one of the loops of the ammunition buffer and in the right hand portion of FIG. 1 ammunition is taken from the conveyer chains 16 through several wheels; they include a transfer wheel 22, a feed wheel 24 and two guide wheels 26, a lower guide wheel for feedback into the container, the upper wheel 26 cooperates with the feed wheel 24 which actually pertains to the gun. Individual rounds are positively held and forced to be transferred through the wheels 22,24 and 26 as well as the upper and lower glide rails 12. Each round is received by the respective endless feed chain of the gun proper (not shown).

The wheels of the transfer unit 20 are connected in a force-locking relationship with the feed wheel 24 of the feed chain of the gun so that the force of the gun provided for receiving a shell is transferred through the conveyer chains 16 upon the conveyer and transfer loop of the buffer in the container 2 for the ammunition. Here the path of the chain in the gun is indicated by and through the two arrows in a rightmost position and also by and through the wheel 24.

A guide wheel 26 with glide rails is provided at the lower side of the several wheels and corresponds to a similar arrangement for the transfer of ammunition on the upper side and leading to the gun. This way spent shells of the guns as well as duds are actually transferred back into the storage system of container 2. The relative positions of the guide wheel 26 and of the feed wheel 24 as pertaining to the feed chain of the gun as well as the transfer wheel 22 may be varied in order to cover a fairly large connection angle as far as the feed chain is concerned and in relation to the gun.

Another major component of the system is the accelerating device 10 which includes the two facing deflection wheels 11 being buffer wheels in the interior of the container 2 and are movably opposite to the local direction of movement of the chains 16. The particular wheels in question are those through which the loops of the chain 16 run. One can see that the right hand loop constitutes the buffer proper for ammunition which is made available immediately during start-up i.e. in the initial phase when the booster motor accelerates. During this period ammunition has to be provided to the gun at the final rate! For this particularly contoured outer position rails 13 provide for guiding of the two associated deflection axles of the wheels 11. In the illustrated example the two deflection axles are interconnected at their ends by means of couplings 28. This connection ensures that the length of the conveyer chain 16 remains constant. Of course it remains inherently constant but the couplings 28 take up away opposing forces that may tend to tear the chains or parts.

The two layers of ammunition provided one on top of the other are separated in the two transport loops of the buffer under utilization of a telescopic device 30. This device constitutes part of the middle one of the partitions in the container (owing to the levels, there are three partitions). The outer segment of the telescope 30 is connected to the shell of the container 2 while the innermost telescopic part is connected to the axle or shaft of the respective movable buffer wheel 11. The telescopic segments are mounted with their respective rear ends in each instance inside the respective large segment under utilization of rollers 32. These telescopic segments are automatically and inherently extended or inserted into each other with the respective smaller one being placed in the respective larger one and so forth. In order to increase the stiffness of the telescope 30 as a whole, the front end of the middle segment is guided in a particular contoured rail of the respective buffer wheel 11. On the side facing the transfer unit a gas pressure spring 34 is provided in the ammunition which spring bears against the outer contour of the container as well as the left buffer wheel 11.

On transfer of ammunition to the transfer unit 20 the gas pressure biased spring device 34 accelerates the ammunition being stored in the two buffer loops as well as the conveyer chains 16, and also the buffer wheels 11, in synchronism with the movement of the gun. The transport mechanism of the gun is actually relieved by the gas pressure spring 34 from the usual movement in the ammunition buffer. The gas pressure spring 34 synchronizes in the beginning of a salvo, or, in the case of variation in the firing rate, the start-up dynamics of the drive motor in the conveyer system on one hand and the gun dynamics on the other hand. This way one obtains start-up delay free firing.

Still another major component is the booster motor 40 or booster engine which in the illustrated example is provided for driving the conveyer chain in the container 2 and is a known motor of the hydraulic variety. This motor is supplied and powered through the existing hydraulics in the aircraft; the motor is being inherently of a rather fast reaction variety. The transfer from the booster motor 40 to the chain 16 is provided by the drive wheel 36 which is positioned directly in front of the buffer loop in the upper portion of the container 2.

Figure 2B:
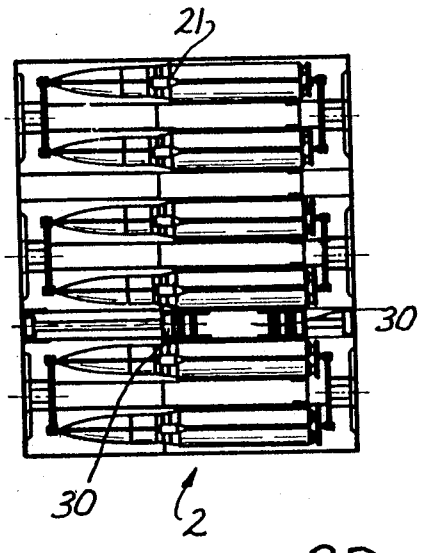
FIGS. 2*a* and 2*b* are detail views of FIG. 2 analogous to FIG. 1*a* and FIG. 1*b*, section planes AA and BB being analogously indicated in FIG. 2.
Figure 2:
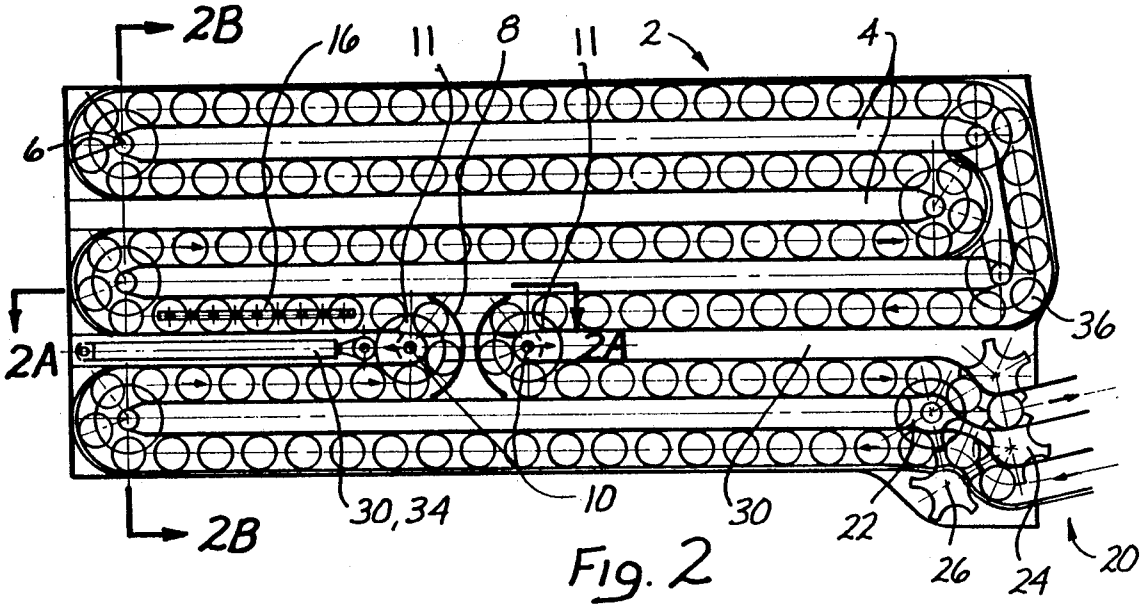
FIG. 2 is a view similar to FIG. 1 but with six rather than four feed levels.
Figure 2A:
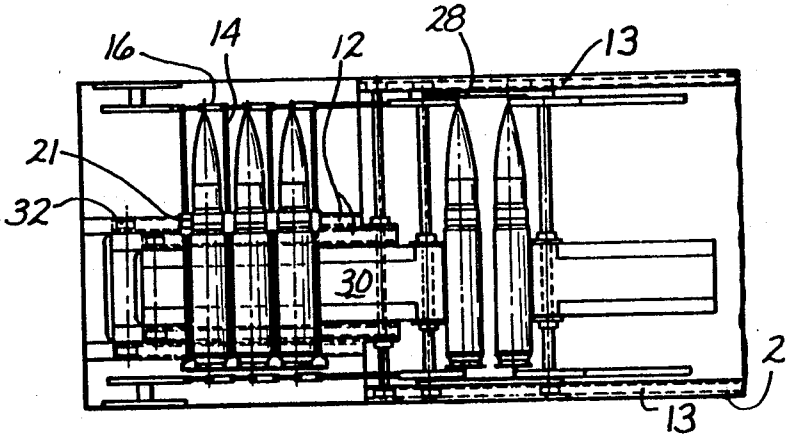

FIG. 2 illustrates a similar arrangement wherein there are six instead of four layers or levels are provided, the container has accordingly a larger capacity.

The inventive ammunition feeding device operates as follows. Prior to taking ammunition from the system a signal e.g. a weapon master signal causes the booster motor 40 to move and accelerate in a direction of normal ammunition transport specifically in order to set the drive wheels 36 into motion. A chain 16 follows in the direction of the arrows. Owing to the fact that at this point in time the wheels in the transfer unit 20 are still motionless, the left hand loop of the buffer is shortened until mechanical abutment obtains. The gas pressure spring 34 being integrated in that loop will receive a maximum bias. Owing to the mechanical coupling of the two wheels 11 (28) the right hand loop of the ammunition buffer is increased by the same amount by which the left hand loop is shortened. It is not necessary to control the booster motor 40. After a mechanical abutment in the left hand side of the buffer obtains, the booster motor 40 may be stalled through blocking the chain 16 in the transfer unit.

As the transfer chain of the gun begins the transport the wheels in the transfer unit 20 illustrated are set into motion to move in synchronism with the gun operation. The biased gas-pressure spring 34 in the left hand loop of the buffer accelerates the two buffer wheels 11 axially in direction towards the transfer unit and relieves the feed chain of the gun. The right hand loop of the buffer is moved to the right until the booster motor 40 has reached maximum speed. Owing to the large supply of ammunition of the buffer one has in fact the entire chain available for that acceleration phase and period which amounts to an ample period of time. The requirements of the booster motor dynamics will in fact be reduced in direct relation to the accelerating period that is made available.

On gun stop the wheels 22, 26 etc. of the transfer unit 20 stop instantly. The inertia of the ammunition and of the transfer system and as well as the booster motor 40 which continues to provide transport operation causes in effect an immediate replenishing of the right hand loop of the buffer with a sufficient amount of rounds of ammunition until it is stopped by the left hand buffer side. Thereupon the blocked chain 16 causes the booster motor to stall.

The gas pressure spring 34 which is integrated above and in the buffer is compressed by this operation and, therefore, has soon maximum bias available for use in the next discharge process. The wheels of the transfer unit 20 may be provided so that the spent shells and duds are taken over and feedback stored in the overall storage system of container 2.

The feeding in accordance with the invention may be initially provided or replenished as follows. A supply of ammunition of the system as described can be replenished on using a suitable ground equipment i.e. similar container is constructed under the same operating principles and can be replaced or replenished in a few seconds. The spent shells etc. are unloaded; this obtains through connecting the ammunition transport chain of the ground device to the transfer unit or the folded chain of the cannon as described and the booster motor simply reverses its sense of direction.

The invention is not limited to the embodiments described above but all changes and modifications thereof, not constituting departures from the spirit and scope of the invention, are intended to be included.

We claim:

1. Device for feeding ammunition to an aircraft firing gun, without using belts, comprising:

an ammunition container having a plurality of partitions to establish a plurality of different levels;

a pair of endless chains being interconnected and run over at least one drive wheel and over a plurality of deflection and buffer wheels;

said partitions acting in concert with said at least one drive wheel and said deflection and buffer wheels to provide a means for running each of the endless chains of the pair through all of said levels, each of said chains forming an endless loop containing two additional loops, said buffer wheels being secured to each other for common movement to thereby couple the two additional loops of each said endless chain together such that as one of the additional loops increases in size the other one decreases in size;

a booster motor connected to said one drive wheel;

a loaded spring means having energy stored on account of loading, the stored energy being released during start up of the booster motor for acting on one of the additional loops to obtain feeder movement of said ammunition during said start up while the booster motor comes up to full speed thereby forcing one of the additional loops to increase in size while the other one of the additional loops to decrease in size; and and a transfer unit with inlet and outlet in the container, including a plurality of wheels.

2. Device as in claim 1 including chain pieces of said endless chain located adjacent at least one deflection wheel of said plurality of deflection wheels.

3. Device as in claim 1, one of the partitions being telescopically variable.

4. Device as in claim 1 including means for holding cartridges between the chains of the pair.

5. Device as in claim 1, the spring means being physically situated inside the one of the additional loops on which the spring means acts directly.

6. Device as in claim 1, there being rail and guide means for the interconnected buffer wheels.

* * * * *